US007275349B2

(12) United States Patent
Auman

(10) Patent No.: US 7,275,349 B2
(45) Date of Patent: Oct. 2, 2007

(54) SPLIT COLUMN REASSEMBLY SYSTEM

(75) Inventor: Barney Jeffery Auman, Logan, UT (US)

(73) Assignee: Barney Auman, Logan, UT (US)

( * ) Notice: Subject to any disclaimer, the term of this patent is extended or adjusted under 35 U.S.C. 154(b) by 0 days.

(21) Appl. No.: 10/696,605

(22) Filed: Oct. 30, 2003

(65) Prior Publication Data

US 2005/0102960 A1 May 19, 2005

(51) Int. Cl.
*E04G 23/02* (2006.01)

(52) U.S. Cl. ..... 52/514; 52/514.5; 138/156; 138/157; 156/60; 264/41

(58) Field of Classification Search ..... 52/514, 52/736.4, 514.5, 730.5, 731.3, 732.2, 741.3, 52/745.21, 736.1, 736.3, 738.1, 745.17, 745.18, 52/737.4, 721.4, 721.5, 724.5; 138/156–158, 138/162, 166, 168, 170; 156/71; 428/33; 285/331, 373; 405/216; 264/45.7, 41, 255, 264/276, 311, 338
See application file for complete search history.

(56) References Cited

U.S. PATENT DOCUMENTS 1,665,995 A * 4/1928 Wiley ..... 52/170
1,999,098 A * 4/1935 Hillyer et al. ..... 52/98
3,984,269 A * 10/1976 Schneller et al. ..... 156/71
4,023,374 A * 5/1977 Colbert et al. ..... 405/216
4,157,271 A * 6/1979 Moore ..... 156/71
4,171,999 A * 10/1979 Allen ..... 156/69
4,244,156 A * 1/1981 Watts, Jr. ..... 52/746.1
4,760,682 A * 8/1988 King ..... 52/731.3
5,333,433 A * 8/1994 Porambo et al. ..... 52/417
5,992,124 A * 11/1999 Robinson ..... 52/721.4
6,009,683 A * 1/2000 Grewe et al. ..... 52/721.4
6,192,646 B1 * 2/2001 Grewe et al. ..... 52/721.4
6,256,961 B1 * 7/2001 Byrnes ..... 52/736.4
6,622,451 B1 * 9/2003 Ellis ..... 52/736.4
6,773,206 B2 * 8/2004 Bradley et al. ..... 405/215
6,941,710 B2 * 9/2005 Eden ..... 52/170
7,141,284 B2 * 11/2006 Newton et al. ..... 428/40.1
2001/0022056 A1 * 9/2001 Gifford ..... 52/311.1

* cited by examiner

*Primary Examiner*—Jeanette Chapman

(57) ABSTRACT

The split column reassembly system invention allows a split column, capitol or base to return to its intended position during its installation around a load bearing structural device. It is done through forming the pieces of the seams in order that they fit back together accurately after separation and during installation.

26 Claims, 6 Drawing Sheets

SPLIT COLUMN REASSEMBLY SYSTEM

CROSS-REFERENCE TO RELATED APPLICATIONS

Not applicable.

BACKGROUND

1. Technology Field

The present invention generally relates to architectural structures including bases, columns, and capitals. More particularly, the present invention relates to multi-piece architectural component systems that can be disassembled and reassembled in precise configurations so as to preserve the integrity and appearance of the structure.

2. The Related Technology

Various architectural components are employed in homes and commercial buildings for a variety of reasons, including enhancement of their appearance, structural integrity, etc. Examples of such components include columns with their corresponding bases and capitals, domes, etc.

Many such architectural components can be manufactured so as to be integrated into or around existing structures or features of the building. For example, columns are often installed as to surround a pre-existing, load bearing post or beam. To enable such an installation, the column must be separated along its length into at least two pieces to enable the column to surround the post or beam. This also holds true for the base and capital that often accompany the column.

A typical result of separating the column as discussed above is two or more column pieces that fail to easily align when brought together around the post. This difficulty in alignment results from various factors, including warping. As such, the joints between the column pieces are typically characterized by uneven edges, gaps, etc. Though such joint defects can be compensated for by various cosmetic procedures, undesired time and costs are nevertheless expended in employing craftsmen to correct such defects. Moreover, such cosmetic procedures fail over time, resulting in cracks and unsightly appearances for the column.

BRIEF SUMMARY

The present invention has been developed in response to the above and other needs in the art. Briefly summarized, embodiments of the present invention are directed to systems and methods for providing multi-piece architectural structures that can be assembled such that the joints between each piece are aligned in a desired configuration with respect to one another, thereby providing the architectural structure with superior appearance and integrity, all while reducing assembly time for the structure.

In one embodiment a multi-portion column assembly is disclosed, comprising a first column portion and a second column portion that together define an interface; an inner surface of the second column portion including a first plurality of surface features adjacent the interface; a backing member included on the second column portion, the backing member including a flange that extends across the interface such that the flange is proximate the first plurality of surface features; and a keying material positioned on the flange, the keying material including a second plurality of surface features that cooperatively intermeshes with the first plurality of surface features when the first and second column portions are mated such that a desired alignment between the first and second column portions is achieved.

In another embodiment, a method for configuring a multi-portion column for assembly is disclosed. In this method, first and second column portions are defined, wherein the second column portion includes an inner surface. A backing member is defined on the first column portion such that a flange of the backing member is positioned proximate the second column portion inner surface, then a pliable keying material is applied to the flange and the inner surface. The flange and inner surface are brought into proximity such that first and second pluralities of surface features are defined in the respective keying materials, wherein the surface features are capable of intermeshing with one another such that the first and second column portions can be positioned in a desired respective orientation when the first and second pluralities of surface features are mated.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

FIGS. 1-3C depict various features of embodiments of the present invention, which is generally directed to a system for aligning and assembling multi-piece architectural structures, including columns, bases, and capitals, as well as other suitable multi-piece structures. Also disclosed is a method by which the system for aligning and assembling such structures can be practiced. Embodiments of the present invention enable the assembly of columns, bases, capitals and other structures in a manner such that a desired alignment is achieved between the various pieces, resulting in a superior structural integrity and appearance for the structure. The joints between the pieces of the structure are aligned and clean, obviating the need for significant joint reconditioning after assembly is complete and hastening assembly time. The resulting joints are also stronger relative to known joining methods, which translates into reduced joint cracking over time. Overall on-site installation is also reduced as a result of practice of embodiments of the present invention as described herein.

As used herein, "structural component" and "architectural component" are understood to include components used in or relating to a home, commercial building or other structure, including load bearing and non-load bearing components that in whole or in part define a portion of the structure.

Figure 1B:
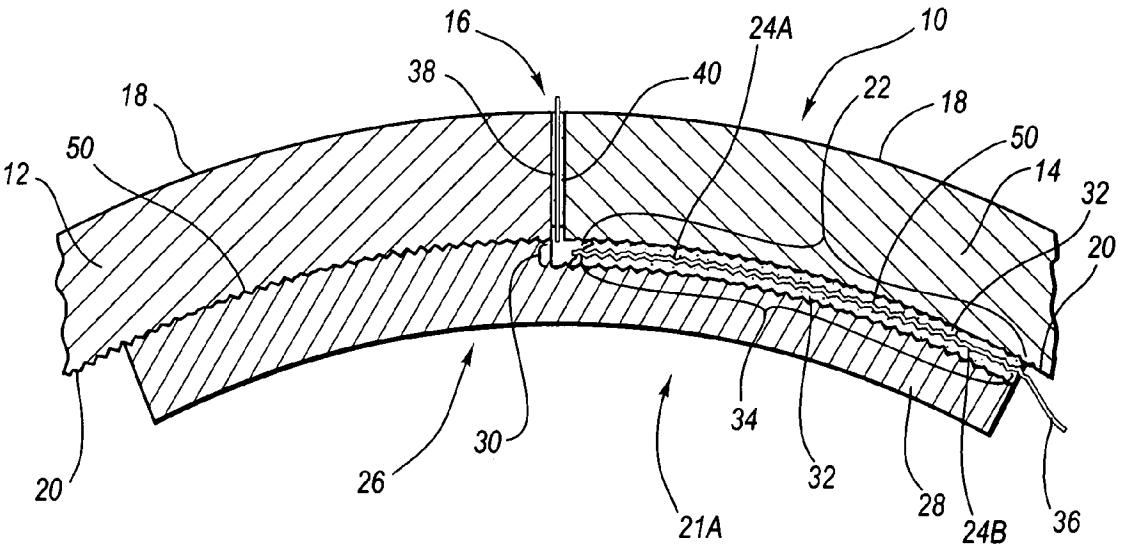
FIG. 1B is a close-up view of a portion of the cross sectional column of FIG. 1A, taken about the circumference 1B-1B.
Figure 1A:
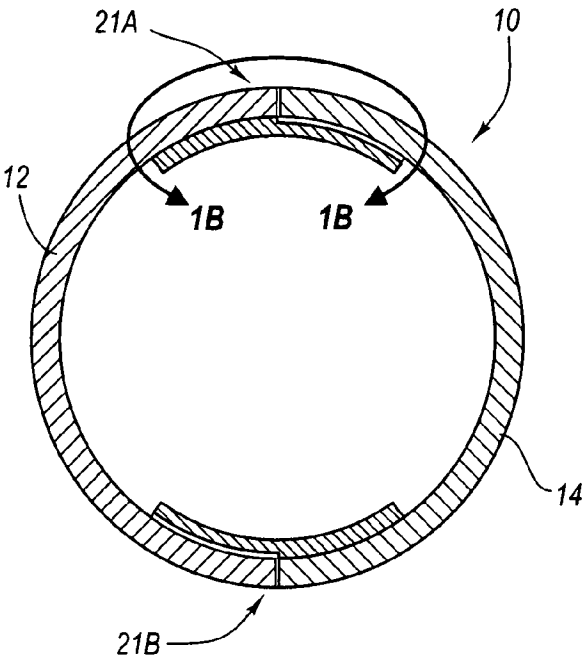
FIG. 1A is a cross sectional view of an architectural column assembly including a column alignment and attachment system, according to one embodiment of the present invention.

Reference is first made to FIG. 1A, which depicts a cross sectional view of a portion of a column assembly, generally designated at 10. The column assembly 10 generally defines a hollow cylinder and is suitable for surrounding another structure, such as a load bearing post in a building, e.g., a home, commercial edifice, etc. While often used for decorative purposes, the column assembly 10 can also fill a load bearing purpose in some embodiments. The column assembly 10 is also often placed in cooperation with a base at a lower portion of the column assembly, and with a capital (not shown) at an upper portion thereof.

As shown in FIG. 1A, the column assembly 10 includes a first column portion 12 and a second column portion 14. First and second column portions 12 and 14 here define half cylinders that mate to define together the column assembly 10. Though they may be initially formed as a single piece or as separate pieces, the column portions 12 and 14 are at some stage during the column manufacturing and assembly process defined as separate pieces, as shown. Also, though two column portions are shown as defining the column assembly 10, it is appreciated that in other embodiments the column assembly or other suitable structure can include three or more pieces. As such, the description to follow is understood to illustrate an exemplary implementation and is not meant to limit the present invention in any way.

More generally, it should be understood that embodiments of the present invention are not limited to their use in assembling columns and their corresponding bases and capitals. Rather, other architectural structures, such as domes, can also benefit from the principles discussed herein. In addition, embodiments of the present invention can be employed in connection with other structures and assemblies not related to architectural or building aspects, including pipes, sculptures and body components for automobiles, aircraft and other vehicles.

As shown in FIG. 1A, column alignment assemblies are shown in connection with the mated first and second column portions 12 and 14 and are generally designated at 21A and 21B. Each column alignment assembly 21A and 21B enables mating of the first and second column portions 12 and 14 to one another in order to form the column assembly 10 in a structurally secure and aesthetically superior manner, as will be discussed below.

Reference is now made to FIG. 1B, which depicts in close-up view further details regarding an exemplary column alignment assembly. In particular, column alignment assembly 21A is shown, and though discussion will center around such, it is appreciated that the same principles will apply to the column, base, or other alignment systems described, shown, or mentioned herein.

In further detail, FIG. 1B shows an interface 16 existing between opposing ends of the first and second column portions 12 and 14. Each column portion 12 and 14 further defines an outer column surface 18 and an inner column surface 20.

A first keyed surface 22 is also included as a portion of the column alignment assembly 21A. In the illustrated embodiment, the first keyed surface 22 is defined by a keying material 32, to be described in detail below, positioned on the inner column surface 20 of the second column portion 14. In particular, the keying material 32 on the inner surface 20 of the second column portion 14 is applied in a pliable state and is configured to define a plurality of randomly occurring surface features 24A, shown in FIG. 1B. In the present embodiment the first keyed surface 22 runs the length of the second column portion 14 proximate the interface 16, as implicitly shown in FIG. 1B. However, in other embodiments, the first keyed surface can be limited to specified portions along the column portion length. In one embodiment, the first keyed surface extends approximately four to five inches (10 to 13 centimeters) from the interface 16.

The column alignment assembly 21A further includes a backing member 26 that is attached in the illustrated embodiment to the first column portion 12 at the inner surface 20 thereof. As shown in FIG. 1B, the backing member 26 is attached to the first column portion 12 by an adhesive 50 applied between a portion of the backing member and the column portion inner surface 20. However, in another embodiment the backing member can be integrally formed with the first column portion as a part of the manufacture of the first column portion. Also, though FIG. 1B shows the first keyed surface 22 on the second column portion 14 and the backing member 26 on the first column portion 12, their respective positions can be reversed in other embodiments. Note that the backing member 26 is curved as to at least approximate the curvature of the inner column surface 20. In one embodiment the backing member is approximately four inches (10 cm) wide and ¼ of an inch (0.6 cm) thick The backing member 26 further defines a flange 28 extending across the interface 16 such that it is positioned adjacent the first keyed surface 22 along the length of the second column portion 14. The flange 28 is recessed from the first keyed surface 22 such that a gap 30 is defined between the first keyed surface and the flange surface. The gap 30 provides a space wherein a keying material 32 can be positioned on the flange 28.

In one embodiment, the keying material 32 is placed on the flange 28 before the backing member 26 is attached to the first column portion 26. In another embodiment, the keying material 32 is placed on the flange 28 while the first and second column portions 12 and 14 are separated. Other keying material application scenarios can also be employed. When placed on the flange 28, the keying material 32 is pliable, and it is applied in sufficient quantities on the flange as to enable it to engage the keying material 32 that defines the first keyed surface 22 of the second column portion 14 when the backing member 26 is positioned as shown in FIG. 1B. Further details regarding the engagement of the keying materials are given further below in connection with discussion of a method of the present invention in accordance with one embodiment. Note that the keying material 32 in one embodiment can be used not only for defining one or both keyed surfaces, explained herein, but also for adhesively coupling the backing member to the respective column portion. In yet another embodiment, the keying material can be employed to define one or more of the backing member, the flange, and the first keyed surface, as well as a second keyed surface that is described in detail below.

A separator 36 is placed between the keying materials 32 positioned on the column portion inner surface 20 and the flange 28 before engagement of these components is performed. In one embodiment, the separator 36 is thin mil plastic sheeting and runs along the length of the second column portion 14 to serve as a barrier preventing contact and adhesive bonding between the two keying materials 32 while remaining pliable to enable forming of the keying materials as described below. In other embodiments, a separator having another thickness or composed of materials other than plastic can also be employed. A chemical release liquid or other substance could also be employed. In one embodiment, one end of the separator is attached to a central portion of the backing member 26 so as to hold it in place.

Compressive engagement of the pliable keying material 32 positioned on the second column portion inner surface 20 with the pliable keying material of the flange 28 while pliable enables corresponding surface features to be imprinted into the keying materials, as explained directly below. Thus a sufficient amount of force of the flange 28 against the inner surface of the second column portion 14 is imposed so as to enable this engagement. Such force can be provided in a variety of ways, but in one embodiment mechanical fasteners such as screws (FIG. 2A) can be used.

As mentioned directly above, compressive engagement of the pliable keying materials 32 enables corresponding surface features to be respectively defined in each of the keying materials. In detail, compressive engagement of the pliable keying materials 32, separated by the separator 36, allows random surfaces features, e.g., "hills," "valleys," etc., to form in the keying materials, thereby defining the first keyed surface 22 of the keying material on the second column portion inner surface 20 and a corresponding second keyed surface 34 in the keying material of the flange 28. As such, a surface feature such as a hill defined by the engagement in the first keyed surface 22 corresponds to a valley correspondingly defined by the same engagement in the second keyed surface 34. Again, adhesive bonding between the keying materials 32 is prevented by interposing placement of the separator 36. The keying materials are allowed to set and harden while indirectly engaged with each other, thereby solidifying the first and second keyed surfaces 22 and 34 in the keying materials. In this way, the first keyed surface includes surface features 24A that correspond to, or are "keyed" to, surface features 24B of the second keyed surface 34. As will be seen, the correspondence of the first and second keyed surfaces allows for superior alignment and assembly of the column 10.

In another embodiment, only one of the keying materials may be pliable, while the other is hardened with pre-defined surface features therein prior to engagement of the keying materials. In this case, the pre-defined surface features of the hardened keying material imprint corresponding and inversely matching surface features in the pliable keying material as a result of the compressive engagement. Further, such pre-defined features can be randomly arranged or produced in accordance with a specified pattern.

Though defined above by keying material applied to the column portion inner surface, the first keyed surface can be defined in other embodiments by other means, such as by surface features on the inner column surface itself. In this case, surface features on the column portion inner surface can be randomly generated, such as by inherent characteristics of the column portion manufacturing process, e.g., in cases where the column assembly is manufactured from fiberglass, or by a specified repeated or unrepeated pattern.

The keying material 32 is composed of a mixture of materials that enables the keying material to perform as described above. In one embodiment, the keying material 32 is a thermal set material including a promoter, an oxidizer/catalyst that serves as a catalyst, and a thickener to provide sufficient viscosity for the keying material. Specifically, in one embodiment, the promoter can include cobalt or dimethylaniline ("DMA") included in a polyester resin, the oxidizer/catalyst is organic peroxide, and the thickener is fumed silica. A strengthener, such as milled glass fibers, can also be added to the keying material to provide added strength.

In other embodiments, other materials can be used that suitably perform the functionality of the keying material as described herein. For instance, walnut shells, flour, or other materials could be used as a thickener. Also, acrylics, epoxies, or cementaceous materials could be employed in the place of a thermal set material. In addition, benzoyl peroxide could be employed as the oxidizer/catalyst. These and other alternative keying material formulations are therefore understood to comprise part of the present invention. In any event, the keying material composition can be chosen so as to suitably perform in the environment and conditions in which the column or other structure will be placed.

A spacer 38 is included along the length of the interface 16 of the column assembly to assist in establishing a clean, straight joint between the first and second column portions 12 and 14. In the present embodiment, the spacer 38 is a strip of thin cardboard, but in other embodiments it can be composed of plastic or other suitable material. Desirably, the spacer 38 is rigid enough to preserve a straight boundary along the interface 16, and is non-porous so as not to bind to the filler (described below) that is placed alongside the spacer. In one embodiment, the separator 36 and spacer 38 can be defined by a single piece of material, wherein the single piece is positioned so as to be interposed both between the keying materials 32 and between the first and second column portions 12 and 14 at the interface 16.

The spacer 38 can be inserted into the interface 16 at one of various points in the column assembly process, depending on the particular process followed. In one embodiment, the first and second column portions 12 and 14, having been each separately molded from fiberglass, are first positioned together in the manner shown in FIG. 1A. If needed, the interface 16 is then widened to accommodate placement of the spacer 38 therein. A filler material 40 is then placed on either side of the spacer 38 as needed to fill in the entirety of the interface along the length of the column assembly. Once the filler 40 is set and the rest of the column alignment assembly 21A is complete as described above, the first and second column portions 12 and 14 can be separated, and the spacer 38 removed, in preparation for reassembly of the column assembly 10 around a post or other structure.

In another embodiment, spacer insertion can occur as follows: the column assembly can be initially manufactured as a single component, after which a suitable interface along the length of the column can be defined, depending on such aspects as whether the backing member was integrally formed with the column, for instance. Then, the column assembly can be cut to define the interface and the corresponding first and second column portions. Insertion of the spacer and filler can then proceed as outlined above.

Notwithstanding the above discussion, it is appreciated that the column assembly and corresponding column alignment assemblies can vary from what has been described. For instance, though shown in FIG. 1B as being attached to only one of the column portions, the backing plate can, in one embodiment be separated into two or more segments that are alternatingly attached to the first and second column portions in an adjacent manner along the length of the interface. In such a configuration, the keyed surfaces of the keying materials would necessarily also alternate in conjunction with the backing member so as to provide the interlocking nature of the first and second keyed surfaces.

As mentioned, once the keying materials 32 placed on the second column portion inner surface 20 and the surface of the flange 28 have hardened while engaged with one another to define the first and second keyed surfaces 22 and 34 thereon, the column assembly is in a state wherein the first column portion 12 can be separated from the second column portion 14 in preparation for placing the column assembly around a pre-existing post, for instance, as will be described below.

Figure 2A:
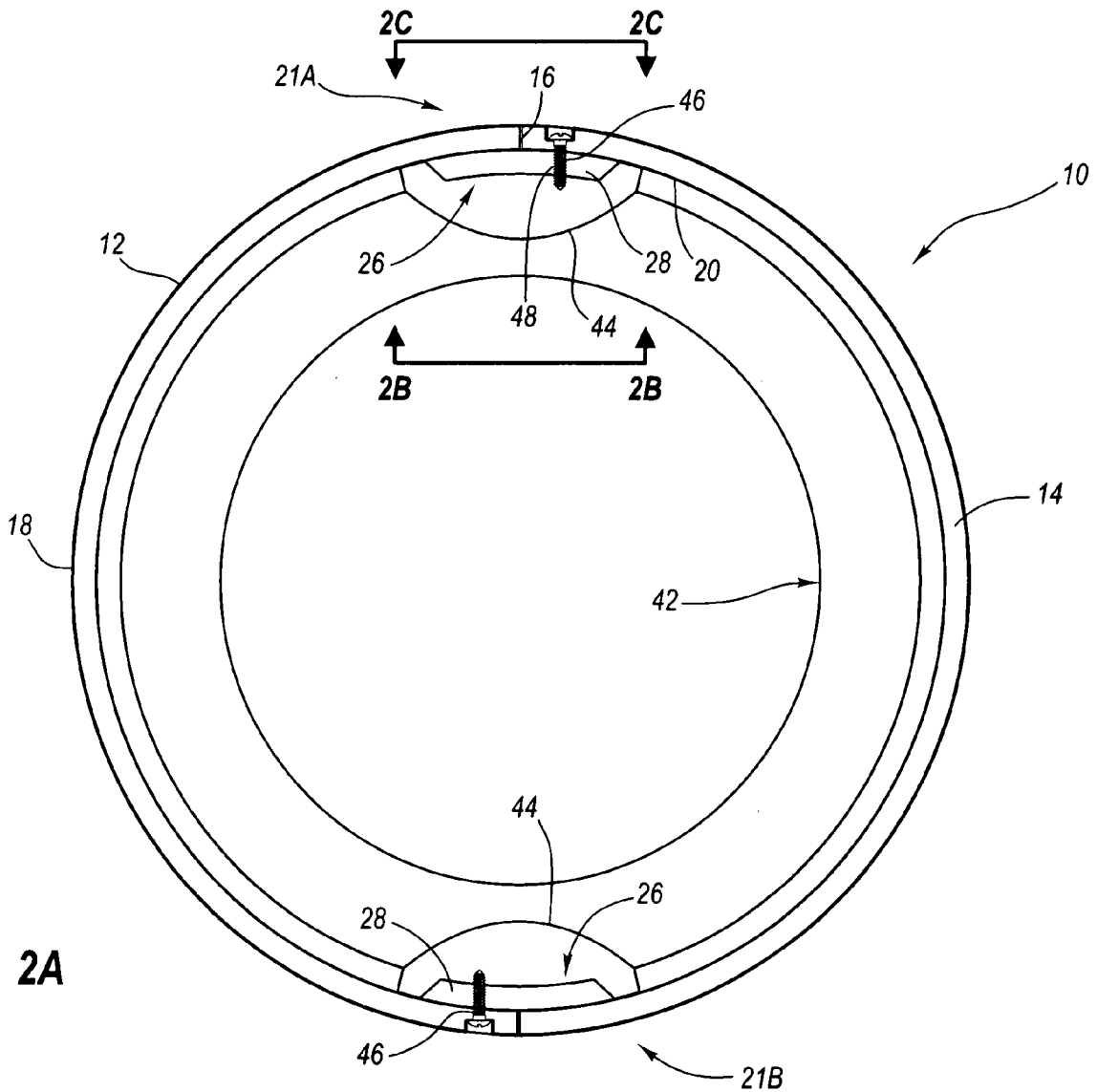
FIG. 2A is a cross sectional view of an architectural column assembly including a column alignment and attachment system, according to one embodiment.
Figure 2C:
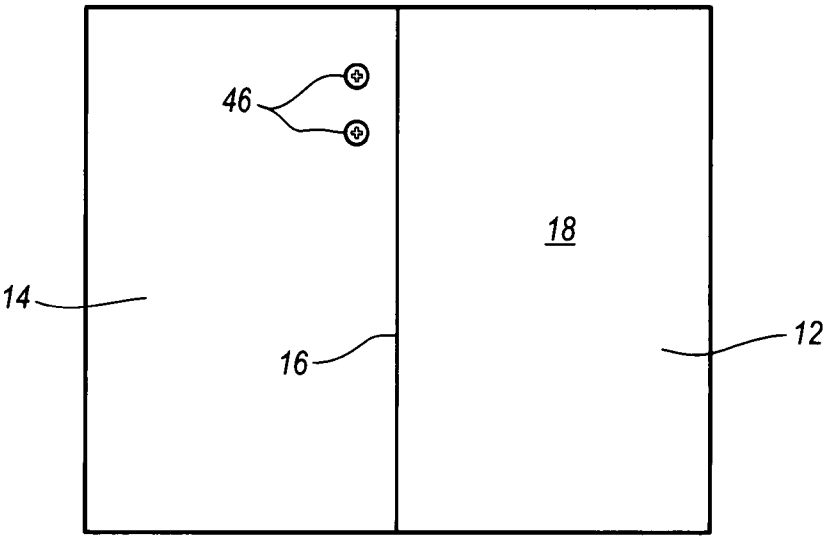
FIG. 2C is a view of an exterior portion of the column assembly of FIG. 2A, OZ taken along the line 2C-2C.
Figure 2B:
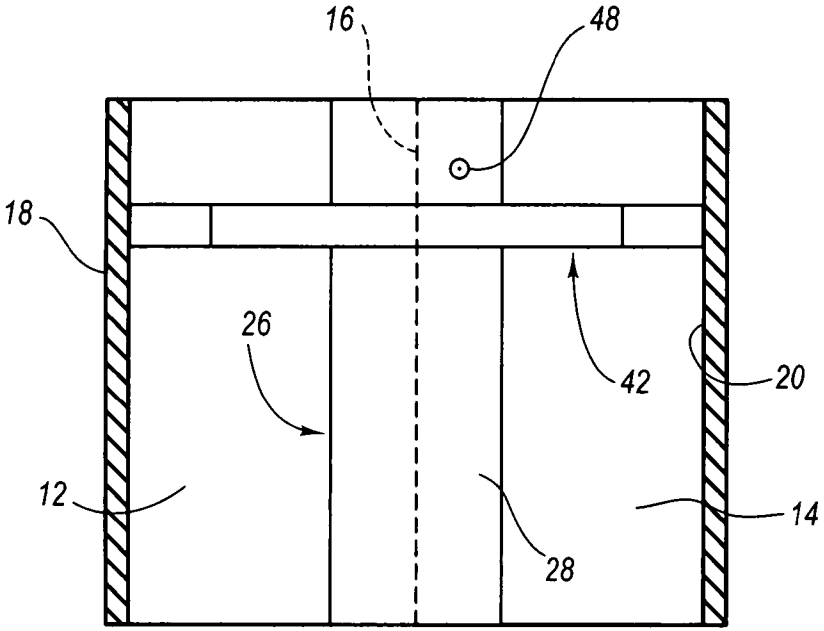
FIG. 2B is a view of an interior portion of the column assembly of FIG. 2A, taken along the line 2B-2B of FIG. 2A.

Reference is now made to FIGS. 2A-2C, which depict various further details of the column assembly 10, according to one embodiment, after preparation and completion of the column alignment assemblies 21A and 21B. In particular, the column assembly includes first and second column portions 12 and 14, together with the column alignment assemblies 21A and 21B and other components, as before described. In addition, the column assembly 10 includes one or more support members 42, positioned about the inner column surface 20 of the column assembly 10. In the present embodiment the support member 42 is positioned as shown in FIG. 2A to provide internal support for the column assembly in order to minimize warping during manufacture, transport, and column placement. However, in other embodiments, such as that shown in FIG. 1A, the support member 42 is not employed. In yet other embodiments, portions of the column assembly 10 along the length of the interface 16 can remain uncut in order to maintain the column portions in a desired orientation with respect to one another. In such a case, the support member 42 need not be used, and placement of the spacer 38 in the interface 16 would wait until the interface is fully cut to define the separate column portions 12 and 14, which cut is usually performed at the worksite immediately before column placement.

In one embodiment, the support member 42 is made from a suitable material, such as wood or plastic, and is annular in shape, having a radius corresponding to that of the inner column surface 20. The support members 42 can be placed at intervals along the length of the column assembly, as partially shown in FIG. 2B, and each includes cutouts 44 that enable the passage of the backing members 26 therethrough. In one embodiment, the support member 42 is made from wood and has a thickness of approximately 7/16ths of an inch (1.1 cm).

FIGS. 2A-2C further depict various mechanical fasteners, i.e., screws 46, which are positioned in corresponding holes 48 in the column assembly 10. As mentioned above, the screws 46 are employed in cinching the flange 28 of the backing member 26 against the second column portion 14 such that engagement of the keying materials 32 and the oz corresponding definition of the first and second keyed surfaces 22 and 34 are achieved. As shown in FIG. 2C, one or more screws 46 can be used along the interface 16 to ensure such keyed surface/keying material engagement. In addition, the screws 46 can be used to maintain the column assembly 10 in its assembled state, together with adhesives, once the column assembly is positioned for use in its final location.

In accordance with embodiments of the present invention, a method is disclosed for aligning and assembling structural components, such as the column assembly 10 described above. In a first stage, the column assembly is manufactured and the first and second column portions are defined. In one embodiment, the column assembly is manufactured as a single piece, while in other embodiments the first and second column portions 12 and 14 are separately produced, such as via fiberglass molding or other suitable process. This stage can further include temporarily joining the first and second column portions together via mechanical fasteners, such as screws, to secure the column portions in a fixed relationship to one another. Again, the present method can be applied to other structures in addition to columns. Definition of the first and second column portions also inherently defines the interface 16 between the column pieces.

In a next stage, the backing member 26 is positioned as to span the interface 16 proximate the inner column surface 20 such that its flange 28 is positioned adjacent the region where the first keyed surface 22 will be defined. Though shown here as being attached to the first column portion 12 by an adhesive after manufacture of the first column portion, the backing member 26 in another embodiment can be integrally formed together with the corresponding column portion as part of the manufacturing process.

Now, the first and second keyed surfaces 22 and 34 are defined to correspond and "intermesh" with one another. In the illustrated embodiment, this is achieved by applying the keying material 32 to both the second column portion inner surface 20 and the flange 28, placing the separator 36 between the keying materials, then bringing the keying materials, while in a pliable state, into compressive engagement with one another. Engagement of the pliable keying materials 32, together with the flexible nature of the separator 36, causes the keying materials to randomly and irregularly form to one another, thereby forming corresponding, inversely matching surface features in the keying materials, in turn defining the first and second keyed surfaces 22 and 34. This compressive engagement is maintained, such as by the screws 46, until the keying materials 32 are set and hardened sufficiently to maintain the definition of the first and second keyed surfaces 22 and 34.

Note that the inversely matching surface features of the first and second keyed surfaces in embodiments of the invention can vary in the degree of similarity in corresponding features. For instance, a protrusion, or "hill," on the first keyed surface can correspondingly define a depression, or "valley," in the second keyed surface, thereby forming inversely matching surface features. The degree of matching of such surface features of the first and second keyed surfaces can be approximate or near-exact, depending on the process followed and the particular needs of the application, but in any case the inverse matching of the surface features is sufficient to cooperatively intermesh the first and second keyed surfaces together to provide a unique and correct fit between the column portions or other structure portions that are to be joined.

The intermeshing first and second keyed surfaces described in the previous paragraphs therefore serve as one exemplary means for intermeshing a first structural portion with a second structural portion, such as the first and second column portions discussed herein. Note, however, that other means for intermeshing portions of a multi-portion structural component are also contemplated, including a first keyed surface defined on an inner surface of one of the column portions that intermeshes with the second keyed surface of the flange, for instance. Thus, these and other suitable means are considered part of the present invention.

In the case where the first and second column portions are separately manufactured, definition of the second keyed surface is preceded in one embodiment by attaching the backing member to the corresponding first or second column portion (if the backing member was not integrally formed with the column portion), applying the keying material to the flange of the backing member, and aligning the column portions in a desired orientation with respect to one another, before compressing the keying material against the first keyed surface. In the case where the column assembly is initially manufactured as a single piece without the backing member formed therein, the column assembly can be cut to define first and second column portions, then proceed as in the above case. In either of the two cases above, it is also possible in one embodiment to maintain the column assembly or the column portions together in a desired orientation, apply keying material to the column portion inner surface and the flange of the backing member, then attach the backing member to the corresponding column portion in such as a way as to mutually define the first and second keyed surfaces in the keying materials. These and other variations are therefore contemplated as part of the present invention.

Note again that in the case where both the first keyed surface and the second keyed surface are composed of and defined by keying material, definition of the first and second keyed surfaces occurs simultaneously as both are pliable when compressive engagement between the two surfaces is achieved. Thus, the surfaces, though separated by the separator, define mutual, random surface features as they are pressed together.

In a next stage, and if not yet performed before, the spacer 38 (FIG. 1B) is placed in the interface 16, which can be widened by a cutting procedure, as explained above. Placement of the spacer 38 is followed by filling any remaining gaps at the interface 16 with the filler 40, as shown in FIG. 1B. The spacer 38 can remain in place until final positioning and assembly of the column assembly is performed. Alternatively, the spacer 38 can be removed beforehand, if desired.

Upon completion of the above stages, the column alignment assemblies, such as the column alignment systems 21A and 21B of the column assembly 10 shown in FIG. 2A are completed, thereby enabling placement and final assembly of the column assembly, such as around a post on a building or other structure. This is done by first separating the first and second column portions 12 and 14 from one another, and removing both the spacer 38 from the interface 16 and the separator 36 from between the first and second keyed surfaces 22 and 34. Note that, in one embodiment, the first and second column portions 12 and 14 can have portions of the interface 16 that remain uncut from the column manufacturing process. If this is the case, those portions must first be cut to enable separation of the first and second column portions.

An adhesive is then applied to the first and second column portions. Locations 50 for the placement of the adhesive can best be seen in FIG. 1B. These adhesive placement locations 50 include the inner column surface 20 of the first column portion 12 and the region between the first and second keyed surfaces 22 and 34. The adhesive can be one of various suitable adhesives, but in one embodiment the adhesive is thermal set adhesive. In one embodiment, the thickness of the separator 36 is selected in part so as to provide adequate volume for a sufficient amount of thermal set adhesive to be positioned between the first and second keyed surfaces 22 and 34, thereby ensuring proper adhesion between the two surfaces when they are joined. In other words, the thickness of the separator 36 creates a small separation between the first and second keyed surfaces 22 and 34 during the formation phase of these surfaces, described above. Thus, when the separator 36 is later removed, a void equaling the thickness of the separator is preserved between the first and second keyed surfaces 22 and 34. This void can then be filled with adhesive, such as thermal set adhesive, which requires a sufficient amount to be present to enable proper thermal setting for good bonding.

Once the adhesive is properly applied, the two column portions 12 and 14 can be fitted around the post or other structure, if present. The two column portions 12 and 14 are then rejoined, intermeshing the first keyed surface 22 with the second keyed surface 34 along the length of the column assembly 10 in a unique fit that ensures the proper and desired orientation of the first and second column portions with respect to one another. The screws 46 can then be reinserted, if desired, to solidify the attachment between the column portions. The holes 48 for the screws 46 can also be used to verify that proper alignment between the first and second column portions 12 and 14 has been achieved. Alternatively, the screws 46 can be omitted from the column assembly 10, and the holes 48 instead filled with a suitable filler material. FIGS. 2B and 2C respectively illustrate interior and exterior views of a portion of the column assembly after final assembly is complete.

Figure 3A:
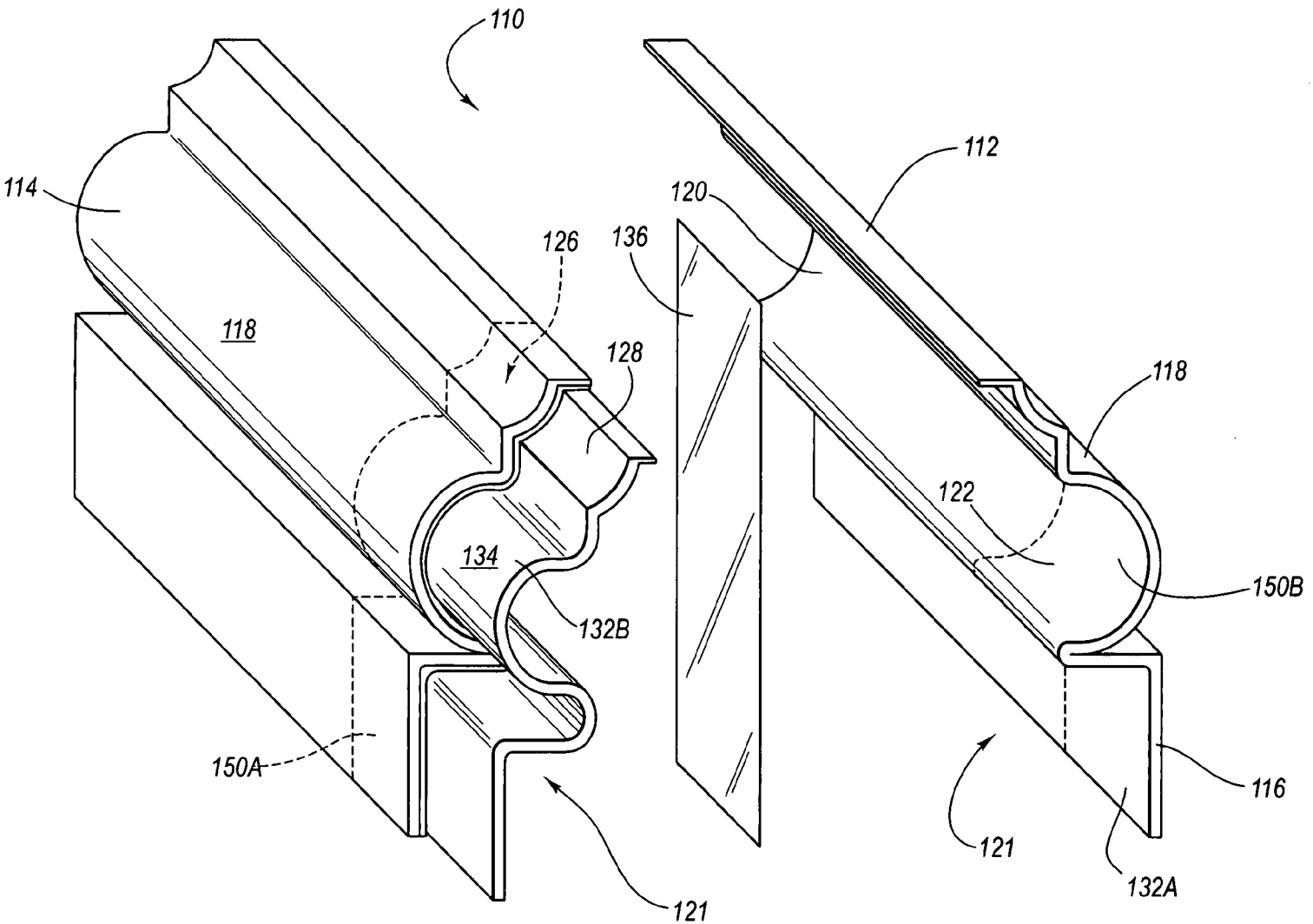
FIG. 3A is a perspective view of a architectural base assembly in a disassembled state and including an alignment and attachment system, according to one embodiment.
Figure 3B:
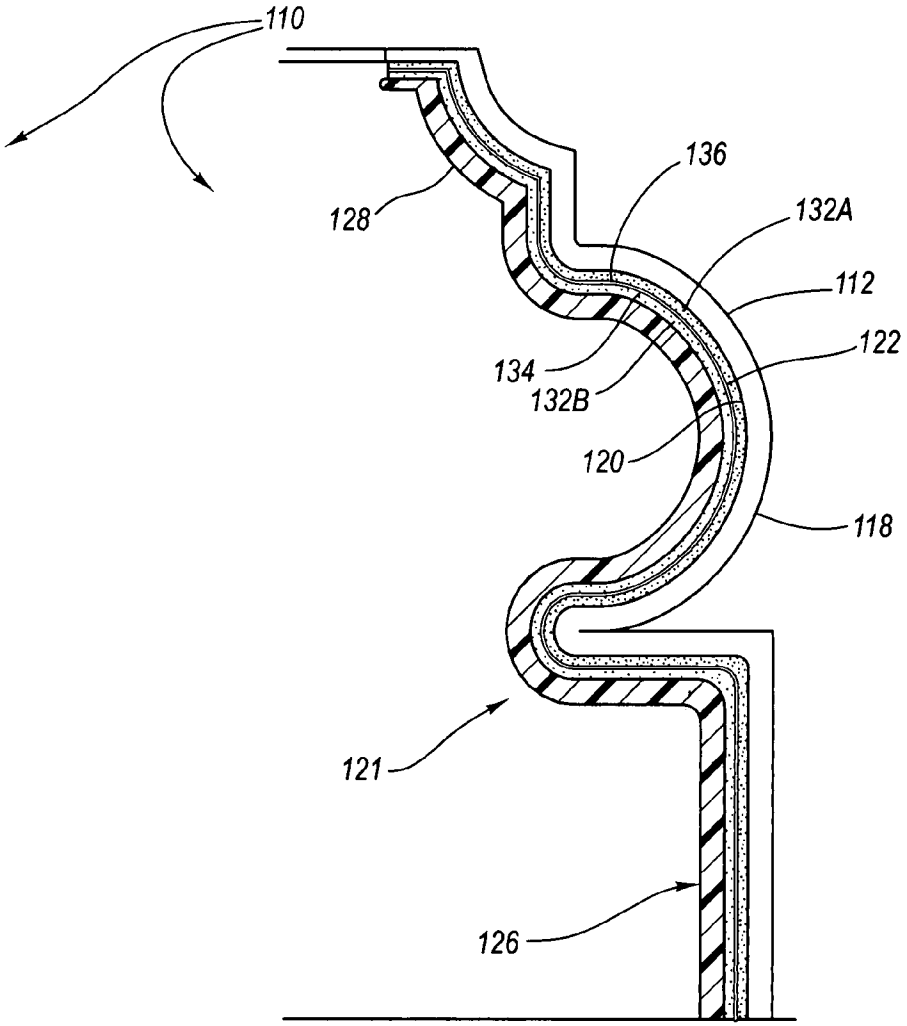
FIG. 3B is a cross sectional side view of the architectural base assembly of FIG. 3A, depicting one stage of a method for aligning and attaching the base assembly together.
Figure 3B:
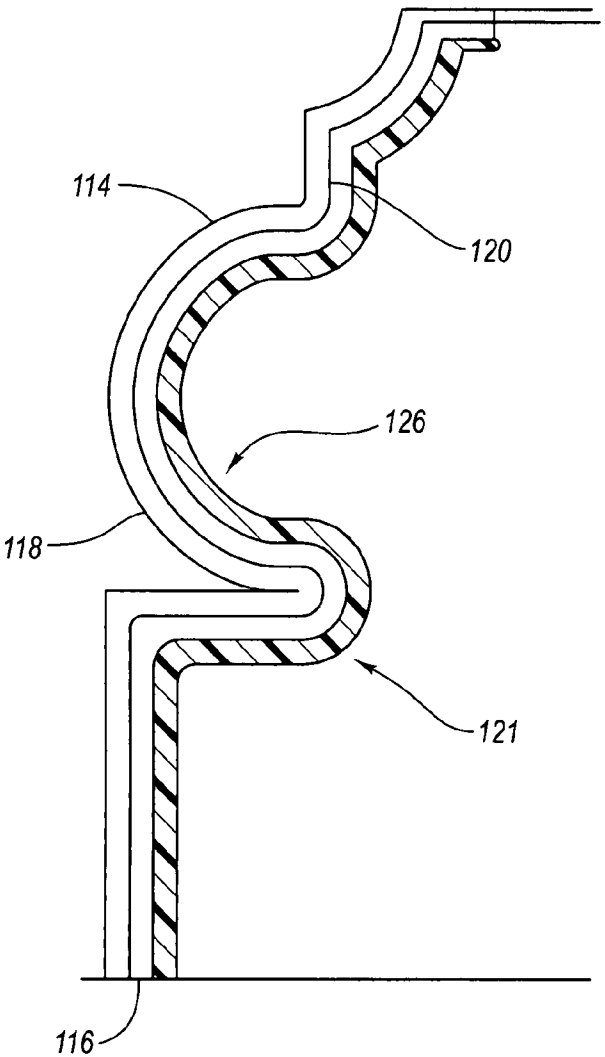
Figure 3C:
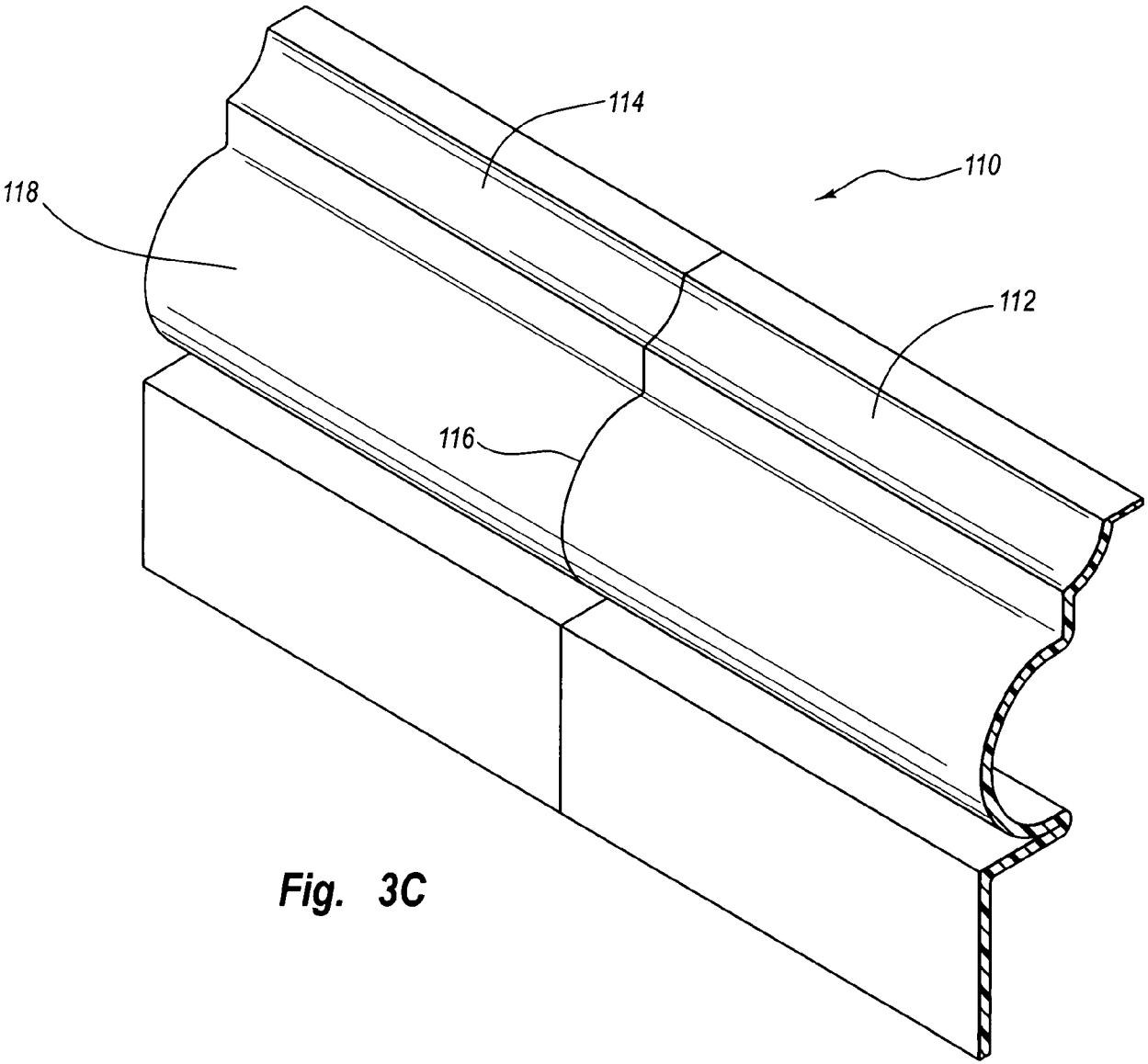
FIG. 3C is a perspective view of a portion of an architectural base assembly in an assembled state, having an alignment and attachment system, according to one embodiment.

Reference is now made to FIGS. 3A-3C. As mentioned, embodiments of the present invention can be used on structures and assemblies in addition to columns. FIGS. 3A-3C illustrate an example of such an alternative application, wherein a base assembly, generally designated at 110, is shown for use with a corresponding column assembly, such as the column assembly 10 previously discussed. It is noted that the base 110 and its manner of assembly shares many common aspects with the column assembly 10 already discussed. As such, only selected details regarding the base 110 and its manner of assembly will be discussed below.

In detail, the base assembly 110 is hollow, and includes first and second base halves 112 and 114 defining an interface 116 therebetween. The first and second base halves 112 and 114 both define an outer base surface 118 and an inner base surface 120. The base assembly 110 further includes a base alignment assembly, generally designated at 121. The base alignment assembly 121 includes various components, as before. In particular, a first keyed surface 122 is defined by keying material 132A positioned on the inner base surface 120 of first base half 112. This can be seen most clearly in FIG. 3B, which shows cross sectional views of the first and second base halves 112 and 114 in an assembled state during which the first keyed surface 122 and a second keyed surface (discussed below) are being defined. Note that in other embodiments the first keyed surface is not defined by a keying material, but rather by surface features naturally existing or formed on the inner base surface of the first base half, as was the case with the column assembly 10 of FIGS. 1A-2C.

A backing member 126 including a flange 128 is positioned adjacent the interface 116 and is attached to the second base half 114. Additional keying material 132B is positioned on the flange 128 and is brought into indirect contact with the keying material 132A, being separated by a separator 136, and secured by compressive engagement. Compressive interaction between the two masses of keying material 132A and 132B creates unique, intermeshing surfaces that form the corresponding first keyed surface 132A proximate the inner base surface 120 of the first base half 112 and a second keyed surface 134 on the backing member flange 128. Once sufficiently hardened, the pieces can be separated for installation about a post or other structure. Alternatively, the first keyed surface 122 can have defined therein surface features that are allowed to set before the keying material 132B of the flange 128 is brought into compressive engagement. In such a case, the keying material 132B is imprinted with the surface features of the first keyed surface 122B. Also, though not shown the base assembly 110 can further include a spacer and filler at the interface 116 to ensure a clean, linear joint between the first and second base halves 112 and 114.

The cross sectional shape of the backing member 126 in the present embodiment conforms to the cross sectional shape of the base assembly 110, as best seen in FIG. 3B. This corresponding shape enables the first and second keyed surfaces 122 and 134 to properly form against one another in preparation for final base assembly. In one embodiment, this is accomplished by forming a flexible piece of fiberglass that is saturated with a catalyzed polyester resin to serve as the backing member 126, against the inner base surface 120 and allowing the piece set to a rigid state having a shape that corresponds to the shape of the inner column surface. The backing member 126 is then removed from the second base half 114, adhesive applied to the backing member 126 at location 150A, and the backing member is reapplied to the second base half as shown in FIG. 3A. Definition of the first and second keyed surfaces 122 and 134 can then proceed as described herein.

When reassembled, the first and second base halves 112 and 114 are secured together using an adhesive at adhesive location 150B indicated in FIG. 3A, after removing the separator 136. The joint region of the final, assembled base assembly 110 appears as shown in FIG. 3C. A similar structure and method is followed in forming a column capital and various architectural and other structures, in accordance with embodiments of the present invention.

It should be noted that the steps recited herein can be performed in an order different from that explicitly described herein, as may be appreciated by one skilled in the art.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A multi-portion structural component system, the system comprising:

at least a first structural portion and a second structural portion together defining an interface;

means for intermeshing the first structural portion with the second structural portion in a unique arrangement such that the first and second structural portions are retained in a desired orientation with respect to one another; and a separator sheet, the separator sheet configured to be temporarily interposed between the first and second structural portions during intermeshing of the first structural portion with the second structural portion.

2. The multi-portion system as defined in claim 1, wherein the means for intermeshing extends on the first and second structural portions along the length of the interface.

3. The multi-portion system as defined in claim 1, wherein the means for intermeshing is proximate the interface.

4. The multi-portion system as defined in claim 1, wherein the means for intermeshing includes:

a plurality of first surface features defined proximate an inner surface of the second structural component; and a backing member included on the first structural component, the backing member including a plurality of second surface features that at least approximately and inversely match the first surface features.

5. The multi-portion system as defined in claim 4, wherein the pluralities of first and second surface features are randomly arranged.

6. The multi-portion system as defined in claim 4, wherein the second surface features are defined in a keying material positioned on the backing member.

7. The multi-portion system as defined in claim 1, wherein the multi-portion structural component is selected from the group consisting of a column, a column base, and a column capital.

8. A multi-portion column assembly, comprising:

a first column portion and a second column portion that together define an interface, the second column portion including a first plurality of surface features adjacent the interface;

a backing member included on the first column portion, the backing member including a flange that extends across the interface such that the flange is proximate the first plurality of surface features; and a keying material positioned on the flange, the keying material including a second plurality of surface features that cooperatively intermeshes with the first plurality of surface features when the first and column portions are mated such that a desired alignment between the first and second column portions is achieved, wherein at least one of the first and second plurality of surface features is defined as a result of the mating of the first and second column portions.

9. The multi-portion column assembly as defined in claim 8, wherein the keying material is a thermal set material, and wherein the first plurality of surface features are defined in a keying material included on an inner surface of the second column portion.

10. The multi-portion column assembly as defined in claim 9, wherein the thermal set material includes a promoter, a catalyst, a polyester resin, and a fumed silica thickener.

11. The multi-portion column assembly as defined in claim 10, wherein the backing member is integrally formed with the first column portion.

12. The multi-portion column assembly as defined 11, wherein the first and second pluralities of surface features are defined by compressively engaging the flange with the inner surface of the second column portion.

13. A method for configuring at least a first and second portion of a multi-portion structural component for assembly, the method comprising:

randomly defining a first plurality of surface features on the second portion of the structural component; and defining a second plurality of surface features on the first portion that inversely match the first surface features such that the first surface features at least approximately intermesh with the second surface features when the first component is mated with the second component as to produce a desired alignment of the first component with respect to the second component.

14. The method for configuring as defined in claim 13, wherein defining the first plurality and defining the second plurality further comprises:

defining the first plurality of surface features in relation to an inner surface of the second portion of the structural component; and defining the second plurality of surface features in relation to a flange of a backing member included on the first portion.

15. The method for configuring as defined in claim 14, wherein defining the first plurality and defining the second plurality further comprises:

defining the first plurality of surface features on a keying material positioned on the inner surface of the second portion; and defining the second plurality of surface features on a keying material positioned on the flange.

16. The method for configuring as defined in claim 15, wherein the first plurality and second plurality of surface features are simultaneously defined by compressively engaging the keying material positioned on the flange with the keying material positioned on the inner surface of the second portion, the keying materials being pliable when the compressive engagement is begun.

17. The method for configuring as defined in claim 15, wherein defining the second plurality further comprises:

defining the second plurality of surface features by compressively engaging the keying material on the flange with the first plurality of surface features, the first plurality of surface features being pre-defined and hardened and the keying material on the flange being initially pliable.

18. The method for configuring as defined in claim 17, wherein an inner surface of the first column portion is non-planar, and wherein the backing member conforms and attaches to the non-planar first portion inner surface.

19. The method for configuring as defined in claim 18, wherein the backing member is composed of fiberglass saturated with a resin to enable it to conform to the non-planar first portion inner surface before hardening to a rigid form.

20. A method of configuring a column assembly, the method comprising:

defining first and second column portions, the second column portion including an inner surface;

defining a backing member on the first column portion such that a flange of the backing member is capable of being positioned proximate the inner surface of the second column portion;

providing a pliable keying material on the flange and on the inner surface of the second column portion; and bringing the flange into proximity with the inner surface of the second column portion such that a first plurality of surface features are defined in the keying material of the inner surface and a second plurality of surface features are defined in the keying material of the flange, the first plurality of surface features capable of intermeshing with the second plurality of surface features such that the first and second column portions can be positioned in a desired respective orientation when the first and second pluralities of surface features are mated.

21. The method of configuring as defined in claim 20, wherein defining the first and second pluralities of surface features further comprises:

placing a separator between the flange and the inner surface of the second column portion before the flange is brought into proximity with the inner surface.

22. The method of configuring as defined in claim 21, wherein the separator is composed of a thin-mil plastic that enables imprinting of the surface features in the keying materials.

23. The method of configuring as defined in claim 22, wherein defining the first and second pluralities of surface features further comprises:

allowing the keying materials to harden; and removing the separator from between the first and second pluralities of surface features after hardening of the keying materials.

24. The method of configuring as defined in claim 23, further comprising:

inserting a spacer in an interface defined between the first and second column portions; and adding filler adjacent the spacer.

25. The method for configuring as defined in claim 24, wherein the first and second column portions remain attached across the interface at predetermined locations along the interface when the first and second column portions are defined.

26. The multi-portion system as defined in claim 1, wherein the means for intermeshing substantially prevents sliding movement between the first and second structural portions along the interface.

* * * * *